US005710398A

United States Patent [19]

Hassler et al.

[11] Patent Number: 5,710,398

[45] Date of Patent: Jan. 20, 1998

[54] HINGED PUSH BUTTON CLUSTER

[75] Inventors: Edgar Glenn Hassler, Sharpsville; Kerry J. Kline, Kokomo, both of Ind.

[73] Assignee: Delco Electronics Corporation, Kokomo, Ind.

[21] Appl. No.: 650,495

[22] Filed: May 20, 1996

[51] Int. Cl.[6] ..... H01H 9/26

[52] U.S. Cl. ..... 200/5 A

[58] Field of Search ..... 200/5 R, 5 A, 200/5 B, 5 C, 5 D

[56] References Cited

U.S. PATENT DOCUMENTS 4,055,734 10/1977 Hayden ..... 200/5 A 4,315,114 2/1982 Monti, Jr. ..... 200/5 A 5,596,343 1/1997 Snider ..... 345/102

*Primary Examiner*—Matthew V. Nguyen

[57] ABSTRACT

For economy of molding and ease of assembly to a control panel, a one-piece cluster of push buttons arrayed in two rows includes hinges coupling groups of buttons. Each hinge is located at the intersection of four buttons and includes an arm extending from a corner of each button in a group. Each arm extends transverse to the plane of the cluster, and the four adjacent arms join to form an arch. Each arm is long and thin enough to be quite flexible for permitting each button to operate independently of the others.

7 Claims, 1 Drawing Sheet

HINGED PUSH BUTTON CLUSTER

FIELD OF THE INVENTION

This invention relates to a push button cluster for a control panel and particularly to a one-piece array of push buttons for assembly in a panel.

BACKGROUND OF THE INVENTION

In an automotive control panel such as used for radios, a number of push buttons are required for selection of various functions, and these buttons are conveniently grouped in a cluster typically comprising two rows of buttons. Where six buttons are used, six different molds are used to make the buttons and the buttons are then separately inventoried and separately assembled to the panel. To minimize the manufacture and handling of many individual buttons during assembly of the control panel, it is desirable to mold an array of buttons with interconnections so that the array or tree can be handled as a unit for installation in the panel. Then only one part is made and assembled to the panel. After assembly, it is required that the interconnections do not interfere with the proper function of the buttons. It is also desirable to avoid a step of severing the interconnections after assembly.

SUMMARY OF THE INVENTION

It is therefore an object of the invention to integrate a two row cluster of push buttons with flexible interconnections to allow assembly as a unit and operation as individual buttons. An additional object is to closely space the buttons of such a cluster. Another object is to contain and guide such individual buttons for independent operation when assembled in a panel.

A cluster of rigid plastic push buttons are molded in one piece as a two row array. Each button has at least one corner adjacent corners of three other buttons and these buttons are coupled by a flexible hinge. The hinge comprises a thin arm on each button extending out of the plane of the cluster substantially at right angles and curving to meet the other arms at a common point to form a U-shaped cruciform structure. Although the buttons are close together, the hinge is flexible due the length and thin section of each arm.

BRIEF DESCRIPTION OF THE DRAWINGS

The above and other advantages of the invention will become more apparent from the following description taken in conjunction with the accompanying drawings wherein like references refer to like parts and wherein.

DESCRIPTION OF THE INVENTION

Figure 1:
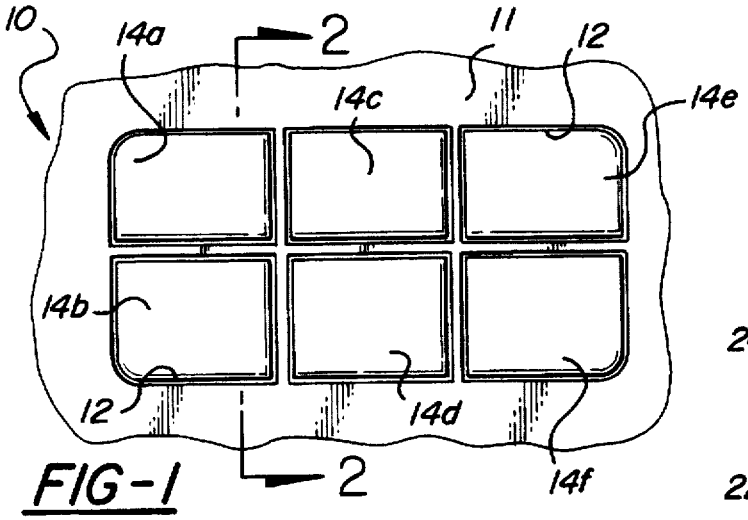
FIG. 1 is a partial front view of a control panel containing a cluster of push buttons according to the invention.
Figure 2:
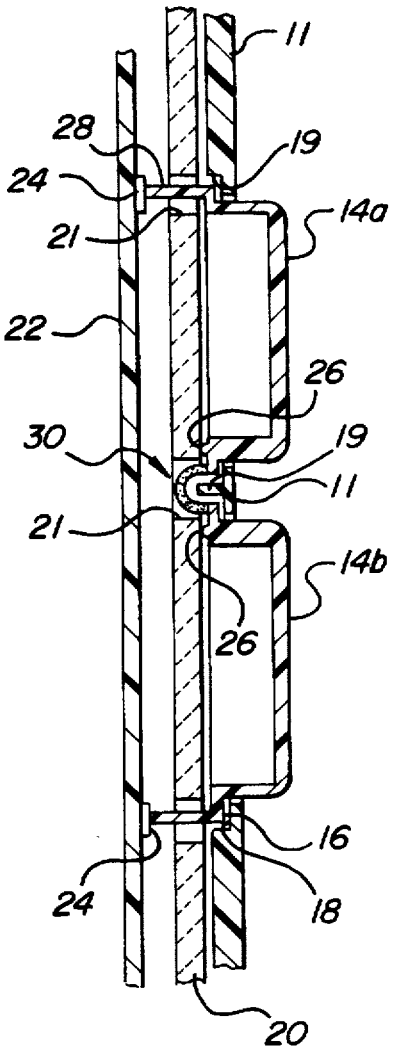
FIG. 2 is a cross section of the panel of FIG. 1 taken along line 2—2.
Figure 3:
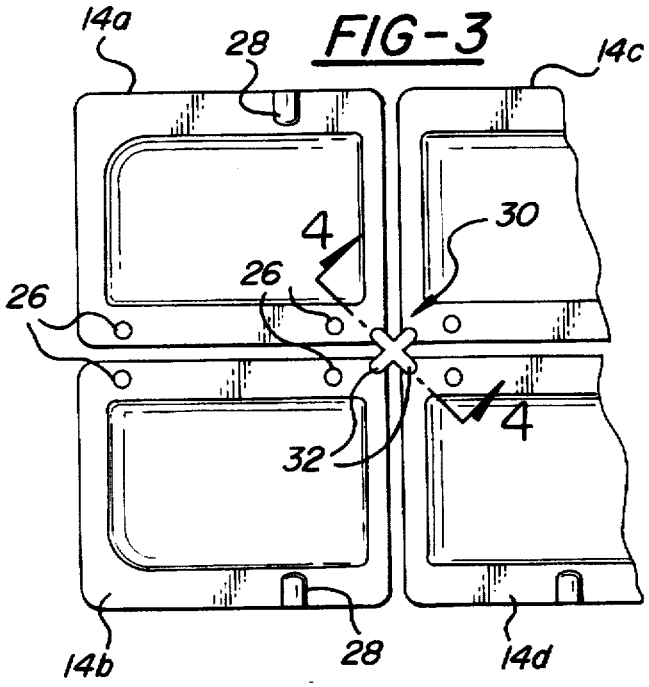
FIG. 3 is a partial rear view of the push button cluster of FIG. 1 removed from the panel.
Figure 4:
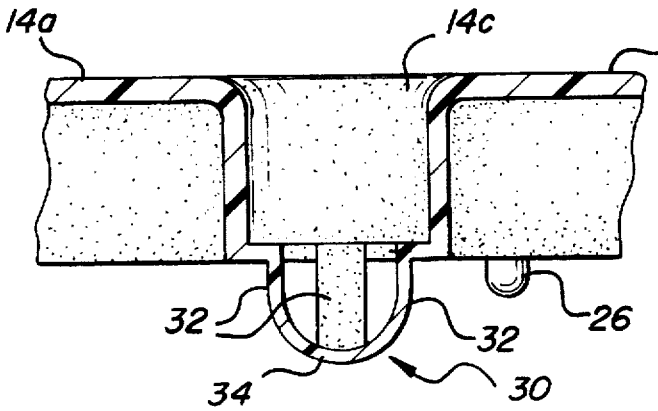
FIG. 4 is a cross section of the cluster taken along line 4—4 of FIG. 3.

Referring to the drawings, a control panel 10 for an automotive radio comprises a trim plate 11 having an array of six openings 12 arranged in two rows. A one-piece push button array 14 or cluster includes push buttons **14*a*–14*f* residing in the openings 12. Both the panel 10 and the buttons are plastic moldings. While the drawings depict the buttons as a single material, they may instead be a composite molding including a clear portion of acrylic or the like to permit illuminated legends or symbols. The buttons have margins 16 which fit in recesses 18 in the rear of the panel, and the recesses are bounded by walls 19 which restrain lateral button movement. A transparent light pipe 20 lies behind the trim plate to illuminate the buttons and to contain the buttons in the trim plate 11. The light pipe has openings 21 to accommodate portions of the buttons which protrude beyond the light pipe surface. A circuit board 22 behind the light pipe 20 contains switches or keys 24** to be operated by the push buttons.

The rear surface of the button margins 16 define a plane of the cluster. A pair of small knobs 26 on one margin of each button bears on the light pipe 20 to form a pivot axis for the respective button. The opposite margin of each button carries a long actuator 28 which extends through an opening 21 in the light pipe to reach a switch 24 on the circuit board. Thus by depressing a button, the button pivots on its knobs 26 to move the actuator against the switch 24. Actuator travel less than 1 mm is sufficient to operate the switch.

To form the one-piece molded array, the several buttons **14*a*–14*f* are joined by hinges 30 at each location where four buttons intersect, so that for the six button array two hinges are required. Each hinge comprises an arm 32 extending from the corner of each button. Each arm has a straight portion substantially normal to the plane of the cluster and a curved portion which meets and joins the other three arms of the hinge, forming a cross at the juncture 34**. This results in an arched cruciform hinge.

The chief purpose of the hinges 30 is to hold the buttons together in a unitary cluster for easy handling and assembly. This eliminates separate manufacture, inventory and assembly of the several buttons. The correct assembly is important to get the right button bearing a given graphic in the right position; this is easily accomplished with the one-piece molding whereas separate buttons require special care to assure proper placement. Once the assembly is completed, it is important that the hinges not interfere with button movement. The hinges are not necessary to switch operation so that if a hinge should break after assembly it will not affect the operation. However since the hinges normally are intact they must be very flexible to allow normal switch operation. The flexibility depends upon the material properties, the length and the cross section area of the arms.

The buttons preferably are molded of a strong rigid plastic such as an ABS-polycarbonate blend having a flexural strength of 13,000 lb/in$^2$, although other materials may be used. Since breakage of the hinge does not present a problem, a strength as low as about 6,000 lb/in$^2$ is acceptable. The hinge structure permits the button margins to be very close together. For a button spacing of 1 mm, a desirable hinge has arms 0.6 mm thick and 1.2 mm wide, and the arched junction 34 extends 3.75 mm from the bottom plane of the buttons or a few times the spacing between the buttons. This assures that each arm 32 is long and thin for good flexibility, i.e., low hinge torque when a button is depressed. The hinge arms and the pivot knobs 26 are substantially aligned so that the hinge experiences the pivotal movement of the buttons and very little if any translation. Even the amount of pivotal motion is small, less than 3° since the actuator 28 moves about 0.75 mm and is about 15 mm from the pivot axis.

It will thus be seen that the one-piece push button cluster allows economies of manufacture and of assembly to a trim plate of a control panel, and that the highly flexible hinge structure permits normal button operation. Further the hinge structure allows very close spacing of the buttons, and is wholly contained within the area of the cluster.

The embodiments of the invention in which an exclusive property or privilege is claimed are defined as follows:

1. A push button cluster for an electrical control comprising:

a one-piece molding containing at least four buttons in a two row planar array such that a corner of each button is adjacent to corners of three other buttons to define at least one intersection;

the molding including a hinge at each intersection for joining corners of four adjacent buttons; and the hinge including an am extending from each button transverse to the plane of the array and joining the arms of the other buttons, wherein each arm is sufficiently thin and long to afford the requisite flexibility.

2. The invention as defined in claim 1 wherein the arms extend substantially at right angles from the buttons and curve to join in an arch.

3. The invention as defined in claim 1 wherein the arms of the hinge comprise an arched cruciform element extending from the array a distance greater than the spacing of the buttons.

4. The invention as defined in claim 1 including:

pivot means at one edge of each button to define a pivot axis for each button;

a switch actuator at an edge of each button opposite the pivot axis; and the hinge am extends from each button adjacent the pivot axis.

5. A push button control panel comprising:

a trim plate having a two row array of openings for push buttons;

a one-piece molding of buttons assembled to the trim plate with a button in each opening;

the molding including an arched hinge at each intersection of four adjacent buttons for joining corners of said four adjacent buttons; and the trim plate having walls around each opening for guiding the buttons during push button operation.

6. The invention as defined in claim 5 wherein each hinge comprises arms extending from the buttons transverse to the plane of the buttons for a sufficient distance to afford the desired flexibility.

7. The invention as defined in claim 5 wherein each hinge comprises arms extending from the buttons transverse to the plane of the buttons and curving together to meet in an arch.

* * * * *